US012180624B2

(12) United States Patent
Dittmann et al.

(10) Patent No.: US 12,180,624 B2
(45) Date of Patent: Dec. 31, 2024

(54) COMPRESSION GARMENT

(71) Applicant: Essity Hygiene and Health Aktiebolag, Gothenburg (SE)

(72) Inventors: Stefan Dittmann, Emmerich am Rhein (DE); Sascha Platz, Emmerich am Rhein (DE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 18/688,687

(22) PCT Filed: Oct. 6, 2021

(86) PCT No.: PCT/EP2021/077481
§ 371 (c)(1),
(2) Date: Mar. 1, 2024

(87) PCT Pub. No.: WO2023/057053
PCT Pub. Date: Apr. 13, 2023

(65) Prior Publication Data

US 2024/0271342 A1 Aug. 15, 2024

(51) Int. Cl.
*D04B 1/10* (2006.01)
*D04B 1/26* (2006.01)

(52) U.S. Cl.
CPC ..... *D04B 1/108* (2013.01); *D04B 1/265* (2013.01); *D10B 2509/028* (2013.01)

(58) Field of Classification Search
CPC ..... D04B 1/108; D04B 1/24; D04B 1/246; D04B 1/26; D04B 1/265; D04B 1/28; D10B 2509/028
USPC ..... 66/171, 172 R, 173, 172 E, 174, 178 R
See application file for complete search history.

(56) References Cited

U.S. PATENT DOCUMENTS 1,772,230 A * 8/1930 Smith ..... D04B 1/26 66/40
2,707,381 A * 5/1955 Lombardi ..... D04B 1/24 66/189
3,425,246 A 2/1969 Knohl
(Continued)

FOREIGN PATENT DOCUMENTS

EP 3067452 A1 9/2016
JP 5204026 B2 * 6/2013
WO 2019163456 A1 8/2019

OTHER PUBLICATIONS

"Medical Compression Hosiery: Quality Assurance RAL-GZ 387/1." Duetsches Institut Fur Guteischerung Und Kennzeichnung E.V. Jan. 2008. (Year: 2008).*
(Continued)

*Primary Examiner* — Grace Huang
(74) *Attorney, Agent, or Firm* — CANTOR COLBURN LLP

(57) ABSTRACT

The present invention relates to compression garments comprising a knitted fabric, wherein the knitted fabric has three or more knitted gores in a proximal portion of the compression garment, and (i) each knitted gore extends circumferentially around 50% or more of the proximal portion; (ii) each knitted gore comprises from 1 to 10 points at which the number of courses is increased; and (iii) each knitted gore comprises from 1 to 10 points at which the number of courses is decreased.

22 Claims, 3 Drawing Sheets

(56) References Cited

U.S. PATENT DOCUMENTS

| | | | | |
|---|---|---|---|---|
| 5,103,656 | A * | 4/1992 | Hanson | A41B 11/003 66/185 |
| 6,178,785 | B1 * | 1/2001 | Samata | D04B 1/26 66/186 |
| 7,485,111 | B1 * | 2/2009 | Choi | A61F 13/107 602/73 |
| 10,137,026 | B2 * | 11/2018 | Evans | A61F 13/01017 |
| 10,487,426 | B2 * | 11/2019 | Kaneda | D04B 9/46 |
| 11,131,044 | B2 * | 9/2021 | Convert | D04B 1/265 |
| 11,717,033 | B2 * | 8/2023 | Giorgi | A41B 11/12 66/178 R |
| 2020/0407893 | A1 * | 12/2020 | Ota | D04B 1/108 |
| 2021/0156058 | A1 * | 5/2021 | Cortinovis | D04B 1/126 |
| 2021/0267810 | A1 * | 9/2021 | Scelles | A61F 13/08 |
| 2022/0167874 | A1 * | 6/2022 | Job | A61B 5/1079 |

OTHER PUBLICATIONS

International Search Report & Written Opinion for International Application No. PCT/EP2021/077481; International Filing Date: Oct. 6, 2021; Date of Mailing: Jul. 1, 2022; 12 pages.

Spencer, David J.; Knitting technology a comprehensive handbook and practical guide; Third edition; Woodhead Publishing Limited; Technomic Publishing Co., Inc.; 413 pages.

Notice of Allowance issued in Mexican Application No. MX/a/2024/004201 dated Jul. 18, 2024.

* cited by examiner

COMPRESSION GARMENT

CROSS REFERENCE TO RELATED APPLICATIONS

This application is a National Stage Application of PCT/EP2021/077481, filed Oct. 6, 2021, which is incorporated by reference in its entirety herein.

TECHNICAL FIELD

The present disclosure relates to a compression garment including a knitted fabric for use in the treatment of lymphatic diseases.

BACKGROUND

Garments which are able to apply pressure to a body part of a subject are known as compression garments and have been used for a variety of therapeutic and non-therapeutic applications, such as treating lymphedema, enhancing athletic performance or for cosmetic purposes. The application of pressure to the affected body part can alleviate symptoms of lymphatic disease and prevent or slow disease progression. Moreover, it is thought to improve recovery after physical training.

Prerequisite for a successful compression therapy is a proper fit of the garment. Garments which fit poorly on the affected body part will reduce adherence of the patient, i.e., reduce the amount of time in which the patient is wearing the garment, and will also not elicit the desired compression level on all areas of the affected body part. In particular for strongly affected body parts which can have a large diameter and an uneven surface morphology, it can be difficult to ensure a good, long-lasting fit of the garment. For such body parts, it has, thus, become routine to manufacture customized garments which are specifically adapted to the body part by manufacturing the garments based on measurements of the respective body part.

Body areas on which it is frequently difficult to ensure a proper fit are the upper thigh area and the proximal part of the upper arm. Patients who, for example, have lymphatic problems in the upper thigh area of the leg, often have thighs with a large circumference and, in particular, a strong protrusion of the anterior (front) and lateral (outer side) regions of the thigh. To cover the entire surface of the upper thigh, but not the buttocks, it is necessary that the front and/or lateral side of the compression garment in this area includes more fabric than the back and/or medial side. At present, this is usually achieved by knitting one or two large gores in the top part of a tube-like thigh-covering structure as schematically shown in FIG. 2.

While this principle can indeed add the required additional fabric to the front and lateral side of the compression garment, it has been shown that stockings which have been constructed in this manner are prone to folding down or rolling down in the area in which the additional fabric is added with the gore. When this happens, the compression exerted in this area will be either too little or too much. Moreover, wearing a garment that is prone to rolling or folding down can be unpleasant and can, therefore, reduce adherence of the wearer. The problem is particularly severe in stockings and arm sleeves of larger sizes or stockings and arm sleeves which are designed for more irregular thighs and upper arms.

There is, thus, a need in the art for compression garments with an improved fit and adherence in the thigh, lower leg or upper arm area, in particular for limbs with a larger diameter or irregular surface.

SUMMARY

This problem is solved by the compression garment as described in the appended claims. According to the disclosure, the additional fabric which is required to cover the proximal part of the thigh, lower leg or upper arm is divided into several regular gores that are spread out over the respective area of the garment and, preferably, separated by constant regions in which the number of courses is substantially the same around the entire circumference of the garment. In the context of the present disclosure, it was surprisingly found that this construction improves the fit in the respective area considerably, in particular in compression garments adapted to be worn on limbs with a relatively large circumference.

In a first aspect, the disclosure relates to a compression garment including a knitted fabric, wherein the knitted fabric has three or more knitted gores in a proximal portion of the compression garment; and (i) each knitted gore extends circumferentially around 50% or more of the proximal portion; (ii) each knitted gore includes from 1 to 10 points at which the number of courses is increased; and (iii) each knitted gore includes from 1 to 10 points at which the number of courses is decreased.

The compression garment may be any type of garment that includes a proximal region that is adapted to fit a body part with highly variable volume. The compression garment will usually be a garment that includes a substantially tube-like structure. The garment can, for example be selected from the group consisting of a stocking, such as a knee-high stocking, a thigh-high stocking (including waist-high stockings); a pantyhose (i.e. a pair of tights); or an arm sleeve, such as an arm sleeve with a hand piece (i.e. a section that is adapted to at least partially cover the hand of a wearer) or an arm sleeve without a hand piece. In preferred embodiments, the garment is a stocking, most preferably a thigh-high stocking.

It will be understood that the term "compression garment" used herein refers to medical compression garments, i.e. garments which are adapted to provide a compression level of any of compression classes 1 to 4 in case the garment is a stocking or pantyhose or 1 to 3 in case the garment is an arm sleeve. The compression classes are defined in more detail elsewhere herein.

The compression garment includes a knitted fabric, such as a weft-knitted fabric. The fabric can be a flat-knitted fabric or a circular knitted fabric, wherein flat-knitted fabrics are preferred. In addition to the knitted fabric, the garment may include further components, such as seams connecting different ends of the knitted fabric, e.g., one or more seams running along the back side of the garment; and/or a knitted or woven band forming the proximal end of the garment. The band can be sewn, glued or welded onto the knitted fabric. In preferred embodiments, the knitted fabric is a seamless piece of knitted fabric. This piece may account for 70% or more, preferably 80% or more, of the surface area of the garment, e.g., if the garment is a stocking or arm sleeve. The piece may account for 70% or more, preferably 80% or more, of the surface area of the garment in the area adapted to cover the leg of the wearer, e.g., if the garment is a pair of tights.

The knitted fabric has three or more knitted gores in a proximal portion of the compression garment, e.g. in the thigh portion, proximal part of the lower leg portion or upper arm portion. As additional fabric is predominantly needed in the upper (proximal) part of the proximal portion, the three or more knitted gores can preferably be in the proximal part of the proximal portion, e.g. in the proximal part (e.g. proximal half) of a thigh portion or the proximal part (e.g. proximal half) of an upper arm portion. However, in particular in cases, in which a lot of additional fabric needs to be added in the anterior, posterior or lateral side of the garment to adapt the garment to the limb shape of the wearer, it is also possible that the knitted gores are in the lower part (e.g. distal half) of the proximal portion. The gores can then be distributed along the proximal portion.

The "proximal portion" of the garment is the part of the garment that is adapted to cover the proximal part of a limb (e.g. leg or arm) or limb part (e.g. lower leg) of a wearer, for example the part of the garment that is adapted to cover the thigh of a wearer in the case of a thigh-high stocking, the part of the garment that is adapted to cover the upper half of the lower leg in the case of a knee-high stocking, or the part of the garment that is adapted to cover the upper arm of a wearer in the case of an arm sleeve. The proximal portion of the garment can, e.g. extend from the proximal end of the garment or from a band forming the proximal end to the beginning of the portion of the garment that is adapted to cover the knee or the elbow of the wearer. In preferred embodiments, the proximal portion is adapted to cover the thigh of a wearer. It can, therefore, also be termed a "thigh portion" in these embodiments. As used herein "to cover a particular body part" means "adapted to be worn on the respective body part when worn correctly, i.e. as intended".

The proximal portion of a thigh-high stocking is its thigh region, i.e. the portion that is adapted to cover the thigh of a wearer. Accordingly, the thigh-high stocking will be covering at least parts of the lower as well as the upper leg. The proximal portion of a knee-high stocking is its proximal part (e.g. the proximal half), i.e. the portion that is adapted to cover the proximal part (e.g. the proximal half) of the lower leg of a wearer. The proximal portion of an arm sleeve is its upper arm region, i.e. the portion that is adapted to cover the upper arm of a wearer.

A "gore", also known as a gusset, is a substantially trapezoidal or triangular knitted section which extends over several rows of knitted stitches. The shape is created in the proximal portion by adding more courses to one or more existing courses in one or more points of increase until a maximal number of desired courses, i.e. a maximal length of the gore in wale direction is achieved, and by—in circumferential direction subsequently—reducing the number of courses in one or more points of decrease until the number of courses is again reduced to the minimal length of the gore in wale direction. As will be further explained elsewhere herein, the minimal length of the gore in wale direction can be 1, 2, 3 or 4 knitted meshes. The gore can in other words also be termed a "knitted section in which the length in wale direction (i.e. the number of courses) is increased and—in circumferential direction subsequently—decreased again to the original length in wale direction (i.e. the original number of courses)". The gore can be symmetrical in circumferential direction. This means that the gore can have one or two wales in its middle with maximal length in wale direction which are distanced from the next point of increase and each subsequent point of increase by the same number of wales as to the next point of decrease and each subsequent point of decrease, respectively.

As schematically illustrated in FIG. 5, knitting of a gore can be achieved by flat-knitting one or more courses with a cam carriage traverse until the—in circumferential direction of the final garment—last (farthest from the starting point of the course) point of decrease, then changing the direction of the knitting and knitting one or more courses with a cam carriage traverse in the circumferentially opposite direction until the first point of increase (closest to the starting point of the first course), then changing the direction of the knitting again and knitting one or more courses in the original circumferential direction until the penultimate point of decrease and so on. Once the desired length in wale direction has been achieved, the course is knitted until the desired end of the gore in circumferential direction and a number of courses having the same length can be added (see below for further information on these constant areas).

A "course" as mentioned herein and in line with the standard meaning in the art is a substantially horizontal row of knitted loops (in an upright fabric as knitted) produced by adjacent needles during the same knitting cycle (compare "Knitting technology—a comprehensive handbook and practical guide", 3$^{rd}$ edition, DJ Spencer, Chapter 3.3). The terms "course" and "knitted row" are used interchangeably herein.

A "wale" is a vertical column of intermeshed needle loops generally produced by the same needle knitting in successive knitting cycles (see "Knitting technology—a comprehensive handbook and practical guide", 3$^{rd}$ edition, DJ Spencer, Chapter 3.4).

The skilled person will understand that the number of courses knitted per cam carriage traverse depends on the knitting machine and settings that are used. Accordingly, the minimal length of the gore in wale direction can depend on the number of cam systems used to manufacture the garment. For example, in case the cam carriage is manufacturing the garment with 1, 2, 3 or 4 cam systems, the minimal length of the gore in wale direction can be 1, 2, 3, or 4, respectively. Similarly, the number of courses which are added in each point of increase or by which the number of courses is reduced in each point of decrease depends on the number of cam systems that are used for manufacturing these parts of the garment.

Each knitted gore extends circumferentially around 50% or more of the proximal portion of the garment. The beginning of the gore is regarded as the beginning of the original course or courses from which the gore is created by adding additional courses and later reducing the number of courses again. Usually, the original knitted course or courses will run around substantially the entire circumference of the garment. In a flat-knitted garment, the course can, e.g., only be interrupted by a seam connecting the sides of the flat-knitted fabric. Accordingly, each knitted gore can extend circumferentially around 90% to 100% of the proximal portion. In other embodiments, each knitted gore can extend circumferentially around 60% or more, 70% or more, 80% or more, or 90% or more of the proximal portion of the garment. In other words, each knitted gore can extend circumferentially around from 60% to 100%, from 70% to 100%, from 80% to 100%, or from 90% to 100% of the proximal portion of the garment. In one example, in which the garment is a thigh high stocking, the knitted gores extend circumferentially around 90% to 100% of the thigh portion.

As noted above, each knitted gore can include several points at which the number of courses is increased and several points at which the number of courses is decreased.

Methods for adding and reducing the number of courses are well known in the art. An exemplary method is described above.

Each of the knitted gores includes from 1 to 10 points at which the number of courses is increased (points of increase); and each knitted gore includes from 1 to 10 points at which the number of courses is decreased (points of decrease). The "number of courses" as mentioned herein means the number of rows of stitches or the number of meshes in stitch wale direction. A point at which the number of courses is increased can, thus, also be termed a point at which the number of meshes in wale direction is increased. Similarly, a point at which the number of courses is decreased can also be termed a point at which the number of meshes in wale direction is decreased.

It will be appreciated that the question of whether a point in which the number of meshes in wale direction is varied is a point of increase or a point of decrease depends on the direction from which this point is looked at. In other words, a point of variance could from the neighboring wale in clockwise direction be regarded as a point of increase, while it would be regarded as a point of decrease when analyzed starting from the neighboring wale in counterclockwise direction. Evidently, in the context of the present disclosure, all points of variance (i.e. points of increase or points of decrease; i.e. points in which the number of meshes in wale direction is varied) will be assessed by comparison with a neighboring wale that is in the same direction (either clockwise or counter-clock wise) adjacent to the respective point of variance. For example, at each point of increase the wale includes more meshes in wale direction than the wale that is its neighboring wale in circumferentially clockwise direction (clockwise when viewed from the proximal end of the garment). For example, at each point of decrease the wale includes less meshes in wale direction than the wale that is its neighboring wale in circumferentially clockwise direction (clock-wise when viewed from the proximal end of the garment).

It will, moreover, be understood, that the term "point" does not infer that the increase in course number is localized to a single wale. Instead, the term "point" refers to a wale in which the number of courses is varied, i.e. a wale that includes less or more meshes than an adjacent wale. However, the wale that is adjacent on the opposite site of the "point" will include the same (increased or decreased) number of wales. The point of increase or decrease can, thus, be regarded as a starting point (wale) for an increase or a decrease, wherein the increased or decreased number of courses (meshes within a wale) will be maintained for a number of further wales.

The gores can, for example, include from 1 to 5 points of increase and from 1 to 5 points of decrease, from 1 to 4, or from 1 to 3. In one embodiment, the gores include 2 points of increase and 2 points of decrease. In some embodiments, each knitted gore includes from 1 to 4 points at which the number of courses is increased, preferably 2, and 1 to 4 points at which the number of courses is decreased, preferably 2.

For example, within a gore, the minimal length of the gore in wale direction (e.g. 1 course/mesh) can have an initial length of e.g. 20 to 40 meshes, then the number of courses can be increased by e.g. 4 courses to 5 courses in total in the next wale in clock-wise direction. The area in which the gore has a length in wale direction of 5 meshes can then have a length of 15 to 30 wales in clockwise direction, then the number of courses can be increased by e.g. 4 courses to 9 courses in total in the next wale in clock-wise direction. The area in which the gore has a length in wale direction of 9 courses can then have a length of e.g. 60 to 200 wales in clock-wise direction, then the number of courses can be decreased by e.g. 4 to 5 courses in total in the next wale in clock-wise direction. The area in which the gore has a length in wale direction of 5 courses can then have a length of e.g. 15 to 30 wales in clock-wise direction, then the number of courses can be decreased by e.g. 4 courses to 1 course in total in the next wale in clock-wise direction. Thereby, the minimal length of the gore in wale direction (in this example 1 course/mesh) is again achieved. This area in which the gore has again the minimal length in wale direction can have a length of e.g. 20 to 40 wales.

The number of points at which the number of courses is increased and the number of points at which the number of courses is decreased within a gore can be identical. Alternatively, the number of points can differ. In the latter case, the extent to which the numbers of courses are varied can be different between points of increase and points of decrease. For example, in each of two points of increase two courses can be added to the gore and in a single point of decrease within the same gore the length of the gore in wale direction can be decreased by four courses. In the garment, the wale direction extends from distal to proximal.

Nevertheless, a more symmetric approach can be preferable. For example, in certain embodiments, 4 courses are added at each point at which the number of courses is increased. In addition or alternatively, the number of courses may be decreased by 4 courses at each point at which the number of courses is decreased. Preferably, 4 courses are added at each point of increase and the number of courses is decreased by 4 at each point of decrease.

The distance between the first point of increase and the last point of decrease within a gore (wherein "first" and "last" are assessed in circumferential direction e.g. in clockwise direction when viewed from the proximal end of the garment) can be 30% or more of the circumference of the proximal portion of the garment in the respective gore. In certain embodiments, the distance between the first point of increase and the last point of decrease within a gore is 35% or more, 40% or more, 50% or more, 60% or more, or 70% or more, wherein 50% or more is preferred. In other words, the distance between the first point of increase and the last point of decrease within a gore is from 30% to 90%, from 40% to 90%, or from 50% to 90%.

As a result of the gores, the garment includes more fabric on the sides of the wearer's leg or arm that have a larger volume than on the others, for example on the anterior and/or the lateral sides in the case of a stocking or on the posterior and/or lateral sides in the case of an arm sleeve. The respective sides of the garment will therefore include more courses than others in the garment. For example, in case the garment is a stocking or pantyhose, the knitted gores can include more courses in an anterior and/or lateral region of the thigh portion than in a medial region of the proximal portion and/or a posterior region of the proximal portion. In a posterior region and/or medial of the proximal portion, the knitted gores can e.g. each have a minimal length in wale direction. Similarly, in case the garment is an arm sleeve, the garment includes—as a result of the gores—more fabric on those sides of the wearer's upper arm that have a larger volume than on the others, for example on the posterior and/or the lateral sides. The respective sides of the garment will therefore include more courses (more meshes in wale direction) than others in the garment. For example, the knitted gores can include more courses in a posterior and/or lateral region of the upper arm portion than in a medial and/or anterior region of the upper arm portion. In an anterior region of the thigh portion, the knitted gores can each have a minimal length in wale direction.

In accordance with the above explanations, the stitch course(s) from which a gore originates, i.e. the course(s) to which the additional courses are added by means known in the art, are regarded as being part of the gore. The number of initial courses (i.e. the minimal length of the gore in wale direction) depends on the cams used to manufacture the fabric. The minimal length of the gore in wale direction may be 1, 2, 3 or 4 courses (meshes in wale direction). Each gore will, therefore, have a height of from 1 to 4 courses at its end and at its beginning when viewed in circumferential direction of the garment.

The "anterior", "posterior", "lateral" and "medial" regions of the thigh portion, lower leg or upper arm portion of the garment are parts of the garment which are adapted to cover an anterior, posterior, lateral or medial portion, respectively, of the wearer's respective limb or limb part. These anatomical terms of location are well known in the art and are used herein in accordance with their usual meaning. For example, "anterior" describes the front (part of the limb/garment), "posterior" describes the back (part of the limb/garment), "lateral" describes the outer side of the limb/garment, i.e. the side that faces away from the other leg or arm of the wearer (when worn correctly), "medial" describes the inner side of the limb/garment, i.e. the side that faces towards the middle line of the wearer's body or that faces the other leg or arm of the wearer (when worn correctly).

It is preferred that the maximal height (i.e. maximal length of a wale) of the gore is in an anterior and/or a lateral region of the proximal portion in case the garment is a stocking, most preferably in the middle between anterior and lateral region. It is preferred that the maximal height of the gore is in a posterior and/or a lateral region of the proximal portion in case the garment is an arm sleeve, most preferably in the middle between posterior and lateral region. The maximal height of each gore can be from 3 to 20 courses, such as from 3 to 15 courses, preferably from 5 to 15 courses, most preferably 10 courses.

For example, the knitted gores can have a height of from 3 to 20 courses in an anterior and/or lateral region of the proximal portion in case the garment is a stocking, preferably from 5 to 15, such as 10. For example, the knitted gores can have a height of from 3 to 20 courses in a posterior and/or lateral region of the proximal portion in case the garment is an arm sleeve, preferably from 5 to 15, such as 10.

The number of knitted gores which are knitted according to the principles described herein can be adapted to the needs of the wearer for whom the garment is intended. For example, in cases in which there is a larger asymmetry between the anterior/lateral and posterior/medial regions of the thigh or lower leg of a wearer or the posterior/lateral and anterior/medial regions of the upper arm of a wearer and a lot more fabric is needed in the respective sides of the garment than, the number of gores that are knitted into the proximal region can be increased. In case the asymmetry is not very pronounced, the number of gores can be lower. Notably, it has been found in the context of the disclosure that a better fit can be provided by adapting the number of gores than by adapting the height of the gores themselves (as done in prior art stockings). Accordingly, the height of the gores can remain the same independent of the asymmetry in the wearer's leg and the required additional fabric. Only the number of gores will be increased or decreased.

For example, the compression garment may include from 3 to 40 of the knitted gores described herein, from 3 to 30, from 3 to 20, such as from 3 to 15. It is preferable that the compression garment includes 3 or more, 6 or more, 8 or more, 10 or more, or 12 or more of the knitted gores, wherein 8 or more is preferred. In other words, the garment can include from 3 to 40, from 6 to 30, from 8 to 30, from 10 to 30, or from 12 to 30 of the knitted gores, wherein from 8 to 30 is preferred.

The maximal height of each knitted gore can be approximately in the middle between the anterior and the lateral region of the proximal portion in the case of a stocking or between the posterior and lateral region of the proximal portion in the case of an arm sleeve. While the middle of the area of the gore which is knitted with the maximal number of courses can coincide with the middle of the gore, the gore can also be asymmetrical so that the area of the gore which is knitted with the maximal number of courses does not coincide with the middle of the gore. The middle of the area that is knitted with the maximal number of courses within a gore can, thereby be shifted e.g. to the lateral side of the proximal portion. These considerations can apply in particular to certain embodiments of flat knitted garments in which the seam connecting the two sides of the flat knitted fabric, preferably in the back of the garment, is regarded as the beginning and the end of the gore. In other embodiments, the gore(s) extend from one side of the flat knitted fabric to the opposing side to which it is connected, i.e. through the seam connecting the two sides.

The gores can also be knitted in a symmetrical manner with respect to each other. This means that the points of increase and the points of decrease can be in the same wales in each gore or, in an alternative approach, that the points of increase and decrease in the different gores are aligned with each other so that in theory they could be connected with a virtual straight line when the garment would lie flat and/or when the garment is worn. A "wale" describes the meshes which are connected with each other, but not in the same course, each wale extends substantially orthogonal to a knitted row/a course.

The knitted gores described herein are preferably separated in longitudinal direction of the proximal portion by constant regions. This separation reduces the stress within the side of the garment that requires additional fabric and prevents the garment from rolling or folding down when the garment is worn. Accordingly, the knitted gores are preferably separated in longitudinal direction of the proximal portion by constant regions. The constant regions will usually consist of from 4 to 56 courses, i.e. the height of the constant regions will be from 4 to 56 courses, from 4 to 46, from 4 to 36, from 4 to 26, or from 4 to 20, such as 16 courses. Preferably, the constant regions consist of from 4 to 26 courses.

As the term "constant" already indicates, the constant regions are characterized by an absence of points of increase or decrease in courses, in particular an absence of knitted gores. The aforementioned number of courses within the constant region, therefore, extend circumferentially around 70% or more of the proximal portion of the garment, preferably from 95% to 100%. Usually, each course within the constant region will run around substantially the entire circumference of the garment. In a flat-knitted garment, the course can, e.g., only be interrupted by a seam connecting two sides of the flat-knitted fabric, e.g. in the posterior part of the garment. Accordingly, each course within the constant region can extend circumferentially around 90% to 100% of the proximal portion. In other embodiments, each course within the constant region can extend circumferentially around 70% or more, 75% or more, 80% or more, 85% or more or 90% or more of the proximal portion of the garment. In other words, each course of the constant region can extend circumferentially around from 70% to 100%, from 75% to 100%, from 80% to 100%, from 85% to 100%, from 90% to 100%, from 95% to 100%, such as 100%, of the proximal portion of the garment. For example, each course of the constant region can extend circumferentially around 75% or more of the proximal portion.

In other words, the number of courses in each constant region can be constant around the circumference of the proximal portion. All courses within a constant region are, hence, "continuous knitting rows", meaning that they are knitted substantially continuously around the entire circumference of the proximal portion (with the possible exception of, e.g., a seam).

The knitted gores described herein and the constant regions are in longitudinal direction of the proximal portion of the garment preferably directly adjacent to each other. This means that the proximal side as well as the distal side of each knitted gore are directly adjacent to a constant region.

In some embodiments, 50% or more of the constant regions within a garment have substantially the same length in wale direction, e.g. 75% or more, or 100% (i.e. all of the constant regions within a garment have substantially the same length or the same length).

In addition to the knitted gores described above, the proximal portion of the compression garment may include a 'proximal gore' forming the proximal end of the proximal portion. This proximal gore can but does not need to have all of the features described above for the knitted gores which are separated by constant regions and which have a defined height. In particular, the proximal gore may have a higher maximal height than the gores described above. The proximal gore may have a height of 8 or more courses in an anterior region and/or lateral region of the proximal portion in the case of a stocking and in a posterior and/lateral region of the proximal portion in the case of an arm sleeve, e.g. 16 or more, 32 or more, 64 or more, or 100 or more. This proximal gore can, e.g. be used if the amount of additional fabric that is needed is too high to be taken up into the knitted gores described above which are separated by regular intervals of constant regions. In such cases, the additional required courses may be added in the form of a proximal gore at the proximal end of the garment in the case of a stocking or arm sleeve or the proximal end of the leg portion of the garment in the case of a pantyhose.

The compression garment is suitable for use in the treatment or prevention of various diseases or conditions which require treatment or prevention with compression therapy. These diseases and conditions include diseases and conditions treated with garments of Compression Class 1, Compression Class 2, Compression Class 3 or Compression Class 4. Diseases and conditions treated with garments having Compression Class 1 (CCL 1) can be e.g. selected from the group consisting of tired, heavy, aching legs; minor varices without edema; mild swelling of the feet, ankles and legs; onset of pregnancy-related varices; primary or secondary lymphedema in International Society of Lymphology (ISL) stages I-III; and lipedema. Diseases and conditions treated with garments having Compression Class 2 (CCL 2) can be e.g. selected from the group consisting of tired, heavy, aching legs; moderate to severe varices with and without edema; moderate to severe pregnancy-related varices with and without edema; moderate edema; chronic venous insufficiency (CVI) C3-C5 according to CEAP; venous edema, skin alterations; healed ulcus cruris; venous ulcers; superficial thrombophlebitis/SVT; diseases and conditions resulting from vein surgery; diseases or conditions resulting from sclerotherapy; post-traumatic edema; post-operative edema; primary or secondary lymphedema in ISL stage II; phlebolymphedema; lipedema. Diseases and conditions treated with garments having Compression Class 3 (CCL 3) can e.g. be selected from the group consisting of severe varices with or without edema; severe edema; chronic venous insufficiency (CVI) C3-C6 according to CEAP; venous edema; skin alterations; healed ulcus cruris; ulcus cruris; venous ulcers; post-thrombotic syndrome (PTS); superficial thrombophlebitis/SVT; conditions or diseases after vein surgery; conditions or diseases after sclerotherapy; primary or secondary lymphedema in ISL stage II; risk of rapid edema rebound; and lipedema. The lymphedema can be e. g. lymphedema with or without shape distortions.

The present disclosure also relates to methods for the treatment or prevention of any of the aforementioned diseases by wearing the compression garment described herein as well as to the compression garment for use in a method of treatment or prevention of any of the aforementioned diseases by wearing the compression garment.

In case the garment is a stocking or pantyhose, the garment can, e.g., be a compression garment having compression class (CCL) 1, 2, 3 or 4. The pressure value at the ankle in these compression classes is 18-21 mmHg (class 1), 23-32 mmHg (class 2), 34-46 mmHg (class 3) and 49 or more mmHg (class 4), respectively. Classification of the garment into these compression classes can be done according to RAL-GZ 387/1. Preferably, the garment is a compression class 1, 2, 3, or 4 garment, most preferably a compression class 1, 2 or 3 garment.

In case the garment is an arm sleeve, the garment can, e.g., be a compression garment having compression class 1, 2 or 3. The pressure value at the measuring point $C_1$ (which is located above the wrist bone) is 15-21 mmHg (class 1), 23-32 mmHg (class 2), and 34-46 mmHg (class 3), respectively. Classification of the garment into these compression classes can be done according to RAL-GZ 387/2. Preferably, the garment is a compression class 1, 2, or 3 garment.

In a second aspect, the present disclosure relates to a method for the manufacture of a compression garment as described herein, including the following steps: (a) measuring the circumference of a leg of a wearer at 3 or more leg heights, including at least one leg height in the area of the thigh in case the garment is a thigh-high stocking or the proximal part of the lower leg in case the garment is a knee-high stocking; or measuring the circumference of an arm of a wearer at 3 or more arm heights, including at least one arm height in the area of the upper arm, in case the garment is an arm sleeve; and (b) knitting the compression garment as described herein, preferably on a flat knitting machine.

Methods for measuring in step (a) are well known in the art and e. g. described in the aforementioned RAL norm RAL-GZ 387/1 in the case of a stocking or a pantyhose and RAL-GZ 387/2 in the case of an arm sleeve. Preferably, the circumference of a leg or an arm of a wearer is measured at 4 or more leg heights/arm heights, or 5 or more leg heights/arm heights. In other words, the circumference of a leg of a wearer can be measured at from 3 to 10 heights of the leg or arm, at from 4 to 10 heights, or from 5 to 10 heights. From these circumference measurements at least 1, preferably 2 or 3, are performed in the area of the thigh in case the garment is a thigh-high stocking, in the area of the proximal part of the lower leg in case the garment is a knee-high stocking or in the area of the upper arm in case the garment is an arm sleeve.

In addition to the circumferences at various positions of the leg or arm, the corresponding heights are also determined to be able to create a customized garment. A height is the length from the floor to the respective position of the leg in which the circumference is measured in case the garment is a stocking or pantyhose; or—in case the garment is an arm sleeve with a hand piece—the length from the base of the middle finger to the respective position of the upper arm in which the circumference is measured; or—in case the garment is an arm sleeve without a hand piece—the length from the wrist to the respective position of the upper arm in which the circumference is measured.

Methods for knitting compression garment in step (b) are well known in the art and further specifications are described elsewhere herein. The knitting can be done by weft-knitting techniques, in particular flat-knitting and circular knitting, wherein flat-knitting is preferred.

A compression garment according to one or more embodiments comprises a knitted fabric having three or more knitted gores in a proximal portion of the compression garment. Each knitted gore extends circumferentially around 50% or more of the proximal portion. Each knitted gore comprises from 1 to 10 points at which a number of courses is increased. Each knitted gore comprises from 1 to 10 points at which the number of courses is decreased.

According to one or more embodiments, the knitted gores are separated in longitudinal direction of the proximal portion by regions absent points of increase or decrease, wherein the regions absent points of increase or decrease include from 4 to 64 courses.

According to one or more embodiments, regions absent points of increase or decrease include from 4 to 32 courses.

According to one or more embodiments, when the proximal portion is adapted to cover the thigh or the lower leg of the wearer, the knitted gores have a height of 2 courses in a posterior region and/or medial region of the proximal portion, and when the proximal portion is adapted to cover the upper arm of the wearer, the knitted gores have a height of 2 courses in an anterior region and/or medial region of the proximal portion.

According to one or more embodiments, the compression garment comprises from 4 to 20 of the knitted gores.

According to one or more embodiments, the compression garment comprises from 4 to 15 of the knitted gores.

BRIEF DESCRIPTION OF FIGURES

Exemplary embodiments of the disclosure are shown schematically in the drawings.

These and other aspects of the invention will be apparent from and elucidated with reference to the embodiments described hereinafter.

DESCRIPTION OF EMBODIMENTS

Additional advantages, characteristics, and features of the present invention will become clear from the following detailed description of exemplary embodiments with reference to the attached drawings. However, the invention is not restricted to these exemplary embodiments.

Figure 1:
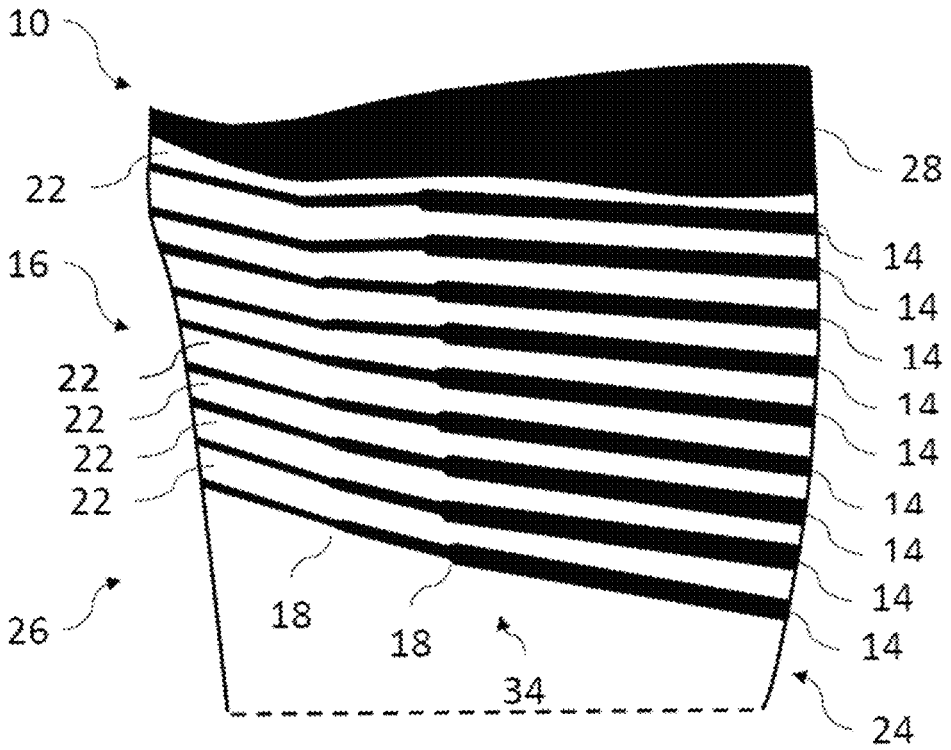
FIG. 1 schematically shows the upper (proximal) end of a proximal region of a compression garment, wherein the knitted gores are depicted in black colour.
Figure 2:
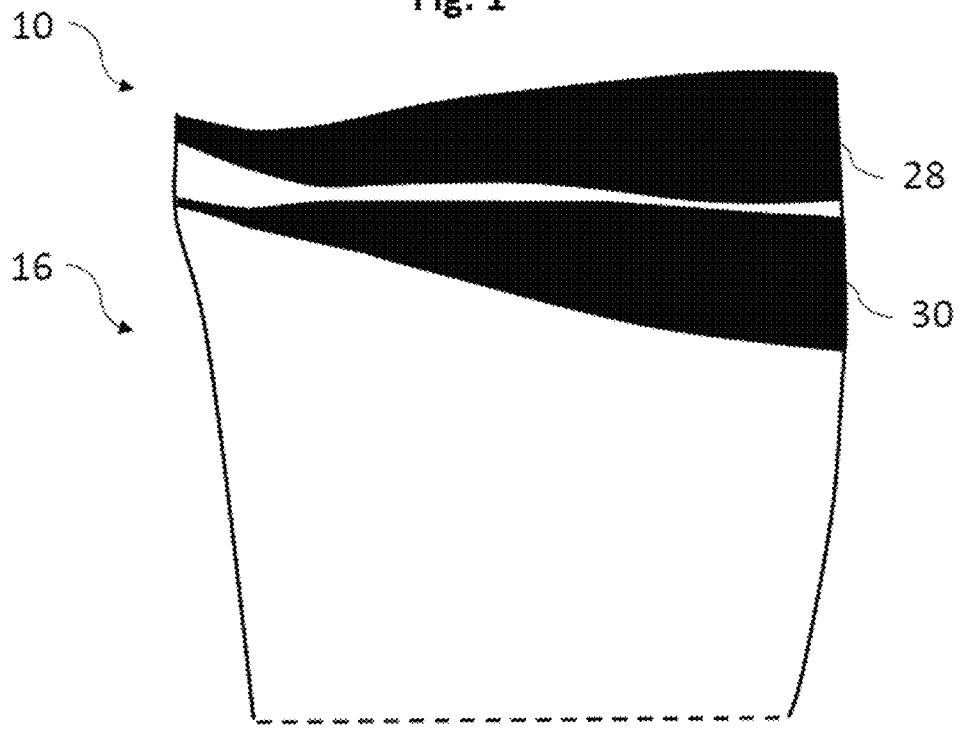
Fig. 2 (Prior Art)
FIG. 2 schematically shows the upper end of a proximal region of a compression garment of the prior art.
Figure 3A:
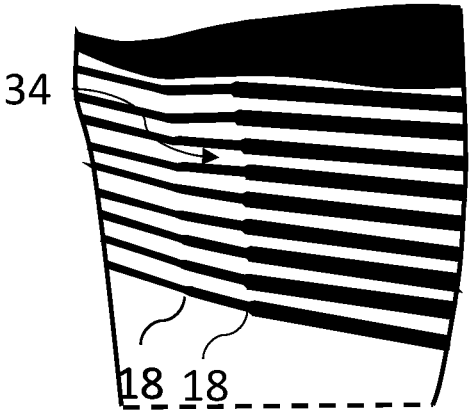
FIGS. 3A-3B schematically show, respectively, the lateral side and the medial side of the upper end of the proximal region of a compression garment shown in FIG. 1.
Figure 3B:
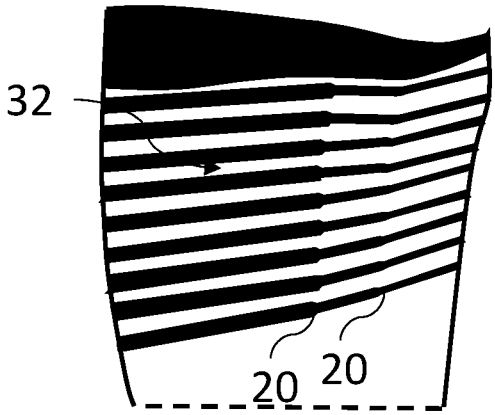

FIG. 1 and FIG. 3A-3B schematically show the upper end of a proximal portion 16 of a compression garment 10. FIGS. 3A-3B schematically show, respectively, the lateral side and the medial side of the upper end of the proximal portion 16 of the compression garment. The knitted gores 14 and the proximal gore 28 are depicted in black colour in FIGS. 1 and 3A-3B (as well as FIG. 2). The colour is merely added to illustrate the shape of the knitted gores 14 and the proximal gore 28. In a real compression garment 10, the yarn(s) in the gores 14 can have the same colour and can be the same yarn(s) as that/those used in the constant regions 16. The entire compression garment 10 can, thus have the same colour.

The compression garment 10 of FIGS. 1 and 3A-3B includes 9 knitted gores 14. Each knitted gore 14 is separated in longitudinal direction of the proximal portion 16 from the next knitted gore 14 by a constant region 22. In addition to these knitted gores 14, the proximal portion 16 also includes a proximal gore 28 which has a greater height in wale direction than the knitted gores 14 and forms the proximal end of the proximal portion 16 and, therewith, also of the compression garment 10, which is a thigh-high compression stocking. Between the proximal gore 28 and the subsequent knitted gore 14, a constant region 22 is located.

Figure 5:
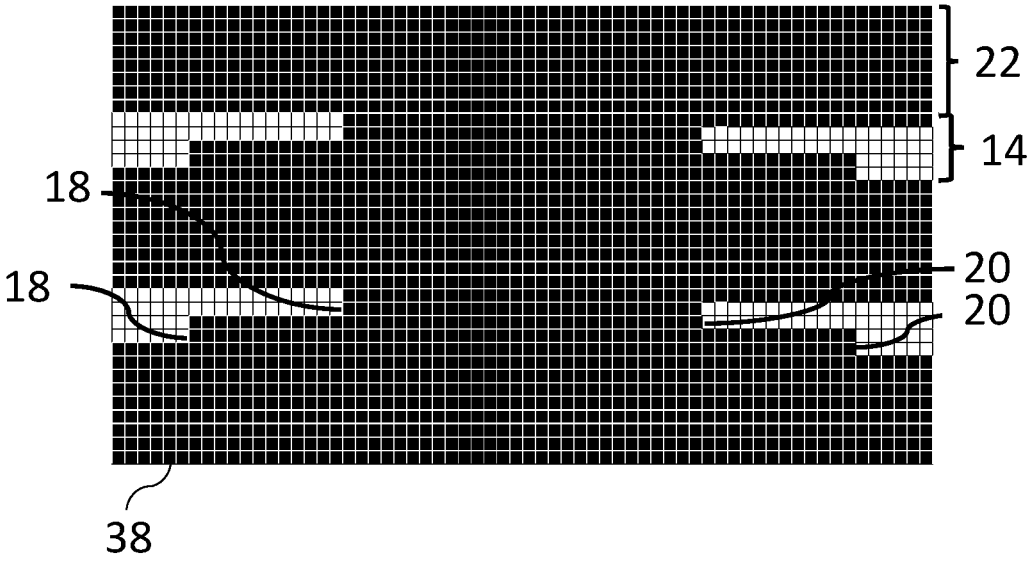
FIG. 5 schematically shows a partial exemplary knitting pattern with three constant regions and two knitted gores, wherein each blackened square represents a knitted stitch.

Each knitted gore 14 has two points of increase in course number 18 that can be seen on the lateral side of the garment 10, in the lateral region 34, in FIG. 3A and FIG. 1. Moreover, each knitted gore 14 has two points of decrease in course number 20 that can be seen on the medial side of the garment 10, in the medial region 32, in FIG. 3B. An exemplary, more detailed schematic way used to create these areas is shown in FIG. 5.

The exemplary knitted gores 14 each start with a height of 2 courses in posterior region 26 of the garment 10 (see FIG. 1). At the first point of increase 18 4 courses are added, at the second point of increase 18 another 4 courses are added. With the resulting maximal height of 10 courses, the gore spans around the anterior region 24, the front part of the garment 10. On the other, the medial, side of the garment 10 that can be seen in FIG. 3B, the number of courses is reduced by 4 in the first point of decrease, resulting in a height of 6 courses. Subsequently, in the second point of decrease 20, the number of courses is again reduced by 4 courses resulting in a final height of 2 courses.

The constant regions 22 have a constant height of 16 knitted courses all around the circumference of the compression garment. No additional courses or partial courses are present between the knitted gores 14 and the constant regions 22. The knitted gores 14 and the constant regions 22 are, in other words, directly adjacent to each other.

It should be noted that even though the schematic representation of each constant region 22 in FIG. 1 and other figures may appear to be of variable height, each actual constant region 22 will have a constant height in wale direction. The apparent variations in the height of the constant regions 22 are merely a result of the simplified schematic graphical display of a three-dimensional structure.

The partially depicted compression garment 10 is a flat knitted garment that is closed in the posterior region 26 with a seam, preferably a flat seam.

FIG. 2 schematically shows the upper end of a proximal region of a compression stocking of the prior art. It can be seen that all of the additional fabric that is required in the anterior region 24 of the garment to compensate for the shape of the leg of the wearer is added in two gores, the proximal gore 28 and a large gore 30. Both gores have a relatively large height in wale direction (i.e. longitudinal direction) in the anterior region of the garment. This practice can cause an instability in the garment and result in rolling or folding down of the upper border region of the garment when it is worn.

Figure 4A:
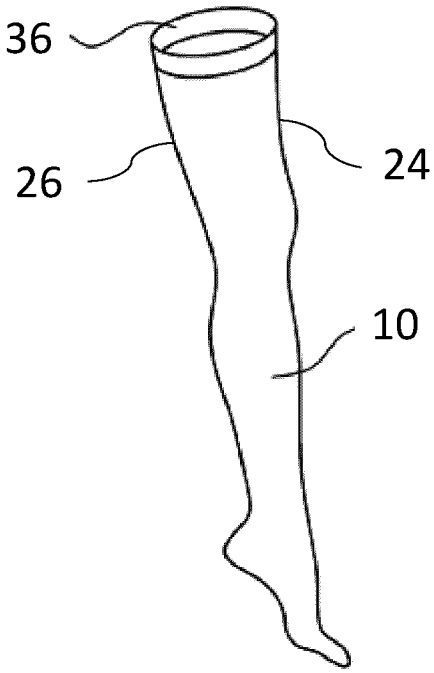
FIGS. 4A-4B schematically show exemplary compression garments, a stocking and pair of tights, respectively, in which the knitted gores are not highlighted, but it is shown where the anterior, posterior, lateral and medial regions of the proximal regions are within the garments.
Figure 4B:
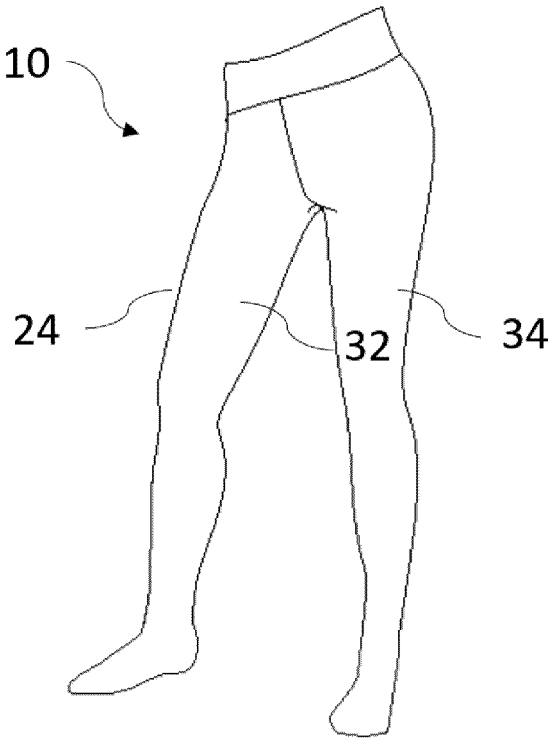

FIGS. 4A-4B schematically show exemplary compression garments 10, a stocking with an upper band 36 and a pair of tights, respectively, in which the knitted gores are not highlighted, but it is shown where the anterior, posterior, lateral and medial regions of the proximal regions are within the garments. The figures merely serve to illustrate where these regions are and to illustrate how finalized compression garments may look like.

FIG. 5 schematically shows a partial exemplary knitting pattern, wherein each blackened square represents a knitted mesh 38. The resulting partial knitted fabric is a flat-knitted fabric. The section which is shown in FIG. 5 consists of three constant regions 22 and two knitted gores 14. Each constant region 22 has a height of 8 courses. Each knitted gore 14 has a height of 1 course on the left and right sides of the section and a height of 5 courses in the middle of the section shown in FIG. 5. The increase and subsequent decrease in height is achieved by addition of courses in two points of increase 18 in the left part of the section shown in FIG. 5 and reduction of courses in two points of decrease 20 in the right part of the section shown in this FIG. 5. In each point, the number of courses is increased or decreased by 2 courses.

It can be seen in FIG. 5 that the pattern is generated by first knitting a course from the start (left side) until the (in circumferential direction) last desired point of decrease 20. Then the cam is reversed and knitting continues in the direction of the start side until the first desired point of increase 18, thereby creating one or more new knitted rows (courses). Subsequently, the cam is reversed and knitting continues in the direction of the end side until the penultimate desired point of decrease 20, thereby again creating one or more knitted rows which are shorter than the first ones. Then, the cam is reversed again and knits until the (in circumferential direction from the start side) second point of increase 18. After the cam is again reversed, it knits a longer course that can e.g. end in the same wale as a subsequent course in the constant region 22.

The number of meshes 38 in circumferential direction which are knitted with the maximal height of the gore will usually be larger than shown in FIG. 5. The relative shortness for knitting with the maximal gore height that is shown here was only chosen to allow the entire principle to be shown in FIG. 5.

Although the present invention has been described in detail with reference to the exemplary embodiments, it is obvious to those skilled in the art that the invention is not restricted to these exemplary embodiments, but rather that modifications can be made in such a way that individual features are omitted or other combinations of the individual features presented are realized, provided that the scope of protection of the appended claims is not exceeded. The present disclosure includes any and all combinations of the individual features presented.

REFERENCE SIGNS LIST

10 compression garment
12 knitted fabric
14 knitted gore
16 proximal portion
18 point of increase in course number
20 point of decrease in course number
22 constant region
24 anterior region
26 posterior region
28 proximal gore
30 large gore
32 medial region
34 lateral region
36 band
38 mesh

The invention claimed is:

1. A compression garment comprising:

a knitted fabric formed as a tube-like structure defining a wale direction and a circumferential direction, wherein the compression garment comprises a proximal portion;

wherein the knitted fabric comprises a proximal gore at the proximal portion, the proximal gore extending from a first terminal end of the proximal portion along the wale direction and having a first height along the wale direction that is a maximum height of the proximal gore;

wherein the knitted fabric has three or more knitted gores in the proximal portion arranged adjacent to the proximal gore along the wale direction; and wherein each knitted gore extends circumferentially around 50% or more of the proximal portion;

wherein each knitted gore comprises a first portion having a first number of courses extending for a first length along the circumferential direction, the first portion having a second height along the wale direction that is a maximum height of the knitted gore; and wherein each knitted gore comprises a second portion having a second number of courses less than the first number of courses extending for a second length along the circumferential direction; and wherein the first height is greater than the second height.

2. The compression garment according to claim 1, wherein the knitted gores are separated in the wale direction by constant regions having a constant number of courses, wherein the constant regions include from 4 to 64 courses.

3. The compression garment according to claim 2, wherein each of the constant regions has the constant number of courses around an entire circumference of the proximal portion.

4. The compression garment according to claim 2, wherein each course of the constant regions extends circumferentially around 75% or more of the proximal portion.

5. The compression garment according to claim 2, wherein constant regions include from 4 to 32 courses.

6. The compression garment according to claim 1, wherein each of the knitted gores comprises a third portion having a third number of courses less than the second number of courses extending for a third length along the circumferential direction.

7. The compression garment according to claim 1, wherein the first portion comprises 4 more courses than the second portion.

8. The compression garment according to claim 1, wherein the second portion has 4 more courses than the third portion.

9. The compression garment according to claim 1, wherein the proximal portion is adapted to cover the thigh, the lower leg, or the upper arm of a wearer.

10. The compression garment according to claim 9, wherein, when the proximal portion is adapted to cover the thigh or the lower leg of the wearer, the knitted gores comprise more courses in an anterior region and/or a lateral region of the proximal portion than in a medial region and/or a posterior region of the proximal portion, and wherein, when the proximal portion is adapted to cover the upper arm of the wearer, the knitted gores comprise more courses in a posterior region and/or a lateral region of the proximal portion than in an anterior region and/or a medial region of the proximal portion.

11. The compression garment according to claim 9, wherein, when the proximal portion is adapted to cover the thigh or the lower leg of the wearer, the knitted gores have a height of 2 courses in a posterior region and/or medial region of the proximal portion; and wherein, when the proximal portion is adapted to cover the upper arm of the wearer, the knitted gores have a height of 2 courses in an anterior region and/or medial region of the proximal portion.

12. The compression garment according to claim 9, wherein, when the proximal portion is adapted to cover the thigh or the lower leg of the wearer, the knitted gores have a height of from 3 to 15 courses in an anterior region of the proximal portion; and wherein, when the proximal portion is adapted to cover the upper arm of the wearer, the knitted gores have a height of from 3 to 15 courses in a posterior region of the proximal portion.

13. The compression garment according to claim 9, wherein, when the proximal portion is adapted to cover the thigh or the lower leg of the wearer, the proximal gore has a height of 8 or more courses in an anterior region and/or a lateral region of the proximal portion; and wherein, when the proximal portion is adapted to cover the upper arm of the wearer, the proximal gore has a height of 8 or more courses in a posterior region and/or lateral region.

14. The compression garment according to claim 1, wherein the first height is at least three times the second height.

15. The compression garment according to claim 1, comprising from 4 to 20 of the knitted gores.

16. The compression garment according to claim 1, wherein the knitted fabric is a flat-knitted fabric.

17. The compression garment according to claim 1, wherein the garment is a pair of tights or a stocking.

18. The compression garment according to claim 1, wherein the garment is a stocking.

19. The compression garment according to claim 1, wherein the garment is an arm sleeve.

20. The compression garment according to claim 1, wherein the first length is greater than the second length.

21. The compression garment according to claim 1, wherein a constant region is disposed between the proximal gore and one of the knitted gores.

22. A method comprising:

measuring the circumference of a leg of a wearer at 3 or more leg heights, including at least one leg height in the area of the thigh or in the area of the proximal part of the lower leg or measuring the circumference of an arm of a wearer at 3 or more arm heights, including at least one arm height in the area of the upper arm;

knitting the compression garment as claimed in claim 1, on a flat knitting machine.

* * * * *